US005306464A

United States Patent [19]

Culling

[11] Patent Number: 5,306,464

[45] Date of Patent: Apr. 26, 1994

[54] ABRASION, EROSION AND CORROSION RESISTANT ALLOY

[75] Inventor: John H. Culling, St. Louis, Mo.

[73] Assignee: Carondelet Foundry Company, Pevely, Mo.

[21] Appl. No.: 42,813

[22] Filed: Apr. 5, 1993

[51] Int. Cl.[5] ..... C22C 38/34

[52] U.S. Cl. ..... 420/49; 420/50

[58] Field of Search ..... 420/49, 50; 148/584.1

[56] References Cited

U.S. PATENT DOCUMENTS

| | | | |
|---|---|---|---|
| 2,938,786 | 5/1960 | Johnson | 75/171 |
| 2,938,787 | 5/1960 | Boyd et al. | 75/171 |
| 3,758,296 | 9/1973 | Johnson | 75/122 |

FOREIGN PATENT DOCUMENTS

| | | | |
|---|---|---|---|
| 53-137818 | 12/1978 | Japan | 420/49 |
| 279959 | 8/1970 | U.S.S.R. | 420/49 |
| 1534926 | 12/1978 | United Kingdom . | |

OTHER PUBLICATIONS

Niu Hong-jun, et al., "Microstructure and Properties of a New Austenitic Heat-Resisting Steel Fe-Cr18-.2-Ni6.9-Mo2.5-C1.5", Heat-Resisting Materials, Proceedings of the First International Conference, Fontana, Wis., U.S.A., 23-26 Sep., 1991, pp. 269-274.

*Primary Examiner*—Deborah Yee

*Attorney, Agent, or Firm*—Senniger, Powers, Leavitt & Roedel

[57] ABSTRACT

Air-meltable, castable, machinable, tough, silicon containing, chromium-nickel-iron alloys that are resistant to hot concentrated sulfuric acid and to abrasive or erosive action of grit or vapor bubbles in the acid. The alloys consist of, by weight, about 15% to about 25% nickel, from about 15% to about 26% chromium, from about 4.5% to about 8% silicon, from about 1% to about 4% copper, from about 0.3% to about 3% molybdenum, from about 0.5% to about 1.7% carbon, up to about 1.5% manganese, and the balance substantially iron plus the usual impurities and incidental tramp elements.

10 Claims, No Drawings

ABRASION, EROSION AND CORROSION RESISTANT ALLOY

This invention relates to ferrous metal alloys composed and structured so as to be superior to stainless steels and nickel base alloys for handling hot concentrated sulfuric acid where abrasion, corrosion and erosion of the metal may occur.

BACKGROUND OF THE INVENTION

Though hundreds of metallic alloys have been developed and employed in the handling of sulfuric acid, relatively few of them are useful in handling hot concentrated sulfuric acid. There are instances in which high hardness or resistance to erosion or abrasion coupled with corrosion resistance is very desirable, such as when vapor bubbles and/or grit are present. The commercial hard alloys for concentrated sulfuric acid handling have been the two nickel base alloys disclosed by U.S. 2,938,786 and U.S. 2,938,787 as well as the high-nickel, cobalt-bearing, low-iron alloy disclosed by U.S. 3,758,296. These alloys are all quite expensive and very brittle.

In British Pat. No. 1,534,926 a broad range of alloy compositions are suggested but examples are only provided of low-nickel stainless steel alloys, said to have excellent resistance to concentrated sulfuric acid. In particular, Table 3 of that patent discloses alloys of 10–17.6% Cr, 15–20% Ni, 4.6–9% Si, 1–2% Cu and 0.8–1% Mo.

According to the '926 patent, the disclosed alloys, besides an austenitic character, may, under certain circumstances be partly ferritic. The '926 patent teaches that it is preferable to have a silicon content of 6.5–12to give completely satisfactory corrosion resistance and that generally the lower limit is 7% because at higher silicon contents (>11%) silicon-containing intermetallic phases, understood to be primarily silicides, are formed very rapidly at certain temperatures thereby reducing the workability of the steel, that is, the steel becomes very brittle.

While it is stated in the '926 patent that the steel can normally contain a maximum of 0.06% C., it is also taught that the carbon content should usually be lower, as for example a maximum of 0.02%. It is further taught that above 0.02% C. it is desirable that one or more carbide-forming elements as niobium, tantalum, zirconium, titanium or vanadium be added to give a total content of these elements within the range of 0.3–2%.

Thus, it has remained very desirable to enhance abrasion and erosion resistance of high silicon steels for use in hot concentrated sulfuric acid by means other than the precipitation of hard silicides or the partial transformation of the matrix to hard brittle ferritic phase.

SUMMARY OF THE INVENTION

Among the several objects of the present invention, therefore, may be noted the provision of alloys resistant to abrasion or erosion and corrosion in hot concentrated sulfuric acid; the provision of such alloys that have an austenitic matrix and are of only moderate gross hardness but that contain substantial quantities of exceedingly hard carbides and are characterized by the absence of additional brittle silicides or a ferritic phase; the provision of such alloys that are readily machined and that may be easily melted and cast in air; the provision of such alloys that are easily formulated to have about two to five percent tensile elongation and are not susceptible to cracking during ordinary foundry production; and the provision of such alloys that may be easily formulated from the readily available elements, iron, nickel, chromium, molybdenum, copper, carbon and silicon.

Briefly, therefore, the present invention is directed to air-meltable, castable, machinable, tough alloys that are very resistant to hot concentrated sulfuric acid and to abrasive or erosive action of grit or vapor bubbles in the acid. The instant alloys consist of, by weight, about 15% to about 25% nickel, from about 15% to about 26% chromium, from about 4.5 to about 8% silicon, from about 1% to about 4% copper, from about 0.3% to about 3% molybdenum, from about 0.5% to about 1.7% carbon, up to about 1.5% manganese, and the balance substantially iron plus the usual impurities and incidental tramp elements.

DESCRIPTION OF THE PREFERRED EMBODIMENT

In accordance with the present invention, alloys are provided which have excellent resistance to hot concentrated sulfuric acid to temperatures of at least 190° C. (375° F.), and good abrasion and erosion resistance.

In testing various steels formulated in accordance with the '926 patent, I have found that when silicon contents are high enough to precipitate hard silicide phases, that are taught would enhance corrosion resistance, these steels are very brittle and have no tensile elongation. Also at levels of silicon that cause precipitation of silicides, the matrices of these steels partially transform to a very brittle ferritic phase.

In particular, I have discovered that it is not only possible but also highly desirable to formulate high silicon alloys with high carbon contents rather than with a limit of 0.06% maximum carbon as required by the '926 patent. Even though the alloys disclosed in the '926 patent are of relatively low raw materials cost, the alloys of the present invention are of even lower cost, in part, due to the fact that they may be formulated to include high carbon ferrochromium in place of the much costlier low carbon ferrochromium required for the alloys of the '926 patent. But far more importantly, alloys of the present invention are tough but yet are able to resist abrasion and erosion because they contain exceptionally hard carbides rather than, as is the case with the alloys of the '926 patent, being brittle due to the formation of much lower hardness silicides or to ferritic phases. In other words, the alloys of the present invention provide superior toughness and abrasion/erosion resistance as well as corrosion resistance and at lower cost compared to the alloys of the '926 patent. Further, the claimed alloys exhibit corrosion resistance comparable to the corrosion resistance of the alloys of the '926 patent.

To achieve these properties I have found that the carbon content of alloys of the invention should be at least about 0.6% up to a maximum of 1.7% and preferably to a maximum of about 1.2%.

In order to achieve the toughness and abrasion resistance of the alloys of the invention, I have found it necessary to limit silicon content to about 8% maximum. A minimum of 4.5% silicon, preferably, a minimum of 6.5% silicon, has been found necessary to achieve optimum resistance to hot concentrated sulfuric acid. A minimum of 15%, and preferably 17%, chromium has been found necessary in the present invention, while a maximum of 26%, preferably 23%, chromium has been found desirable.

I have further found that the carbides in the alloys of the invention contain chromium contents of about 6.08 %times the carbon content of the alloys and silicon contents of about 0.256 %times the carbon content of the alloys. For example, in an alloy of 1% C. content, 6.08% Cr and 0.256% Si will be contained in the carbides, while the remainder of each element will be dissolved in the matrix. Therefore, a substantial portion of the chromium content but very little of the silicon content is removed from the matrix of alloys of the invention due to the formation of carbides. I have also found that the amount of nickel in the instant alloys that is removed from the matrix due to carbide formation is equal to about 0.228 % times the carbon content. Thus, most of the nickel remains in the matrix of the instant alloys.

Molybdenum helps alloys of the invention achieve a passive state even when present in amounts as low as about 0.3%. Greater than about 3% Mo is not of further benefit and would require further increases in nickel content and is therefore not desirable.

In summary, the primary components of the alloys of the invention are:

| | |
|---|---|
| CHROMIUM | 15-26% BY WEIGHT |
| NICKEL | 15-25% |
| SILICON | 4.5-8% |
| CARBON | 0.5-1.7% |
| COPPER | 1-4% |
| MOLYBDENUM | 0.3-3% |
| MANGANESE | UP TO ABOUT 1.5% |
| IRON | ESSENTIALLY THE BALANCE |

Up to about 1% of the nickel content may be replaced by cobalt without detriment. Fractions of a percent of the usual impurities, deoxidizers and trace elements carried over from recycled castings and scraps may also be present without detriment.

Although nitrogen is neither required nor found to be beneficial to alloys of the invention, the amount of nitrogen absorbed into the melt during air melting does not result in any detrimental effects to the instant alloys.

While the above specified ranges of component elements may be employed in thin or light castings since such castings cool fairly rapidly, for most applications it has been found desirable to restrict the ranges to the following:

| | |
|---|---|
| CHROMIUM | 17-23% BY WEIGHT |
| NICKEL | 15-23% |
| SILICON | 6.1-7.7% |
| CARBON | 0.5-1.2% |
| COPPER | 2-4% |
| MOLYBDENUM | 0.3-3% |
| MANGANESE | 0.3-1% |
| IRON | ESSENTIALLY THE BALANCE |

An especially useful formulation with excellent chemical, physical and mechanical properties is nominally as follows:

| | |
|---|---|
| CHROMIUM | 18 BY WEIGHT |
| NICKEL | 17% |
| SILICON | 7% |
| CARBON | 0.8% |
| COPPER | 2.5% |
| MOLYBDENUM | 1% |
| MANGANESE | 0.5% |
| IRON | 53% |

While the iron content (plus impurities) of the alloys of the invention can vary from about 30% to 59%, it would vary from about 35% to 57% for the preferred range but usually varies between about 48% and about 54% in alloys having the most desirable combination of chemical, physical and mechanical properties for most casting designs. The most desirable hardness is about 250 to 350 Brinell Hardness Number (BHN).

EXAMPLE 1

Heats of several different alloys were prepared in accordance with the invention. Tensile test bar keel blocks and corrosion test blocks of each alloy measuring 2.5 inches long by 1.25 inches wide by 0.4 inch thick were cast in dry sand mold. The composition of these alloys is set forth in Table I, with the balance in each case being essentially iron.

TABLE I

ALLOYS OF THE INVENTION COMPOSITION BY WEIGHT PERCENTAGE

| ALLOY No. | C | Si | Ni | Cr | Mo | Cu | Mn |
|---|---|---|---|---|---|---|---|
| 1 | 1.02 | 6.11 | 15.32 | 18.98 | 2.02 | 2.13 | 0.32 |
| 2 | 0.86 | 6.15 | 19.09 | 19.25 | 2.88 | 2.59 | 0.49 |
| 3 | 0.55 | 6.33 | 19.02 | 21.19 | 0.59 | 2.67 | 0.50 |
| 4 | 0.89 | 6.51 | 18.49 | 21.02 | 1.48 | 2.08 | 0.65 |
| 5 | 0.76 | 7.02 | 17.12 | 18.10 | 1.02 | 2.51 | 0.86 |
| 6 | 0.69 | 7.49 | 19.68 | 17.96 | 0.67 | 1.79 | 0.48 |
| 7 | 0.61 | 7.74 | 16.83 | 17.03 | 0.51 | 3.18 | 0.55 |
| 8 | 0.92 | 7.71 | 21.35 | 18.61 | 0.38 | 2.30 | 0.50 |

Using the as cast, non-heat treated standard physical test blocks of each heat, standard tensile test bars were machined and the mechanical properties of each were measured. The results of the measurements are set forth in Table II.

TABLE II

MECHANICAL PROPERTIES OF THE ALLOYS OF THE INVENTION

| ALLOY NO. | TENSILE STRENGTH P.S.I. | YIELD STRENGTH P.S.I. | TENSILE ELONGATION % | BRINELL HARDNESS NUMBER |
|---|---|---|---|---|
| 1 | 73,900 | 60,600 | 2.5 | 277 |
| 2 | 56,500 | 42,800 | 4.0 | 255 |
| 3 | 59,600 | 45,300 | 3.5 | 260 |
| 4 | 59,800 | 47,400 | 4.7 | 305 |
| 5 | 57,500 | 43,100 | 3.5 | 295 |
| 6 | 71,100 | 52,100 | 2.5 | 303 |
| 7 | 60,200 | 54,800 | 2.1 | 297 |
| 8 | 60,600 | 55,100 | 2.0 | 335 |

EXAMPLE 2

Test blocks in the as cast condition from all test heats were immersed in 600 ml beakers containing 95 to 98% sulfuric acid at various temperatures for 24 %hour periods in such a manner that they were supported on one end by a bed of half-inch diameter glass marbles and on the other end by the side of the beakers so that all faces were in contact with the solution. Each test block was weighed to the nearest 1,000th of a gram before and after the immersion and the weight loss was converted to a figure of average depth of corrosion penetration in mils per year, MPY, in accordance with the relationship:

$$MPY = 303.7 \frac{Wo - Wf}{ATD}$$

where

Wo=ORIGINAL WEIGHT OF SAMPLE

Wf=FINAL WEIGHT OF SAMPLE

A=AREA OF SAMPLE IN SQUARE CENTIMETERS

T=DURATION OF THE TEST IN YEARS

D=DENSITY OF THE ALLOY IN GRAMS PER CUBIC CENTIMETER

The results of these tests are set forth in Table III.

TABLE III

WEIGHT LOSS IN 95-98% SULFURIC ACID AT VARIOUS TEMPERATURES FOR ALLOYS OF THE INVENTION

| TEMPERATURE | ALLOY 1 | 2 | 3 | 4 | 5 | 6 | 7 | 8 |
|---|---|---|---|---|---|---|---|---|
| 80° C. | 0.2 | 0.3 | 0.3 | NIL | NIL | NIL | NIL | NIL |
| 90° C. | 0.3 | 0.5 | 0.4 | 0.1 | 0.1 | NIL | NIL | 0.2 |
| 100° C. | 0.5 | 0.7 | 0.6 | 0.2 | 0.1 | 0.1 | NIL | 0.4 |
| 110° C. | 1.1 | 1.1 | 0.8 | 0.4 | 0.2 | 0.2 | 0.1 | 0.6 |
| 120° C. | 2.6 | 2.3 | 1.6 | 1.1 | 0.5 | 0.4 | 0.3 | 1.1 |
| 130° C. | 4.7 | 4.2 | 2.7 | 2.1 | 1.1 | 0.8 | 0.7 | 0.7 |
| 140° C. | 8.1 | 7.8 | 4.7 | 4.2 | 2.1 | 1.7 | 1.3 | 2.2 |
| 150° C. | 11.0 | 11.6 | 11.5 | 6.2 | 3.6 | 2.6 | 2.1 | 3.3 |
| 160° C. | 15.7 | 16.2 | 13.6 | 9.3 | 5.6 | 5.0 | 3.2 | 3.5 |
| 170° C. | — | — | — | 14.4 | 9.0 | 6.2 | 5.0 | 5.2 |
| 180° C. | — | — | — | — | 15.7 | 9.1 | 7.8 | 8.2 |
| 190° C. | — | — | — | — | — | 16.3 | 12.7 | 13.1 |

Assuming a maximum permissible corrosion rate of 20 MPY, which is considered by those working in the art as a reasonable rate, these test results indicate that alloys of the invention containing about 6% Si are serviceable in 95 to 98% sulfuric acid to about 160° C., while those containing 7% Si are usable to 180° C., and those of about 7.7% Si content may be employed to 190° C. It is evident that the presence of high carbon contents and the formation of hard carbides in alloys of the invention have not kept them from becoming passive in concentrated sulfuric acid even at very high temperatures.

EXAMPLE 3

Ordinary type 304, or 18% Cr-8% Ni, stainless steel withstands 99% sulfuric acid to 190° C. without severe chemical attack but has poor resistance to abrasion or erosion. Furthermore, if the acid is reduced in strength only very slightly to 95%, the attack on 304 stainless steel increases 30 to 100 times, depending upon temperature. Even ordinary gray cast iron may be employed in cold, very concentrated sulfuric acid but is rapidly attacked if the acid strength is lowered only very slightly. Contrariwise, the alloys of the present invention have very good resistance to sulfuric acid even when the acid strength is reduced to about 80%.

In the manner of Example 2, %samples of alloys of the invention were immersed in 80% sulfuric acid at several temperatures. The results of these test are set forth in Table IV.

TABLE IV

WEIGHT LOSS IN 80% SULFURIC ACID AT VARIOUS TEMPERATURES ALLOYS OF THE INVENTION

| TEMPERATURE | ALLOY 1 | 2 | 3 | 4 | 5 | 6 | 7 | 8 |
|---|---|---|---|---|---|---|---|---|
| 80° C. | 1.1 | 1.3 | 0.7 | 0.6 | 0.3 | 0.1 | NIL | NIL |
| 90° C. | 2.7 | 2.6 | 1.2 | 1.3 | 0.6 | 0.3 | 0.2 | 0.3 |
| 100° C. | 5.7 | 4.9 | 3.1 | 2.8 | 1.5 | 0.8 | 0.4 | 0.3 |
| 110° C. | 11.6 | 12.2 | 6.4 | 6.6 | 3.3 | 1.5 | 0.9 | 0.8 |

From this data it is evident that alloys of the invention withstand temperatures to at least 110° C. without catastrophic failure even when acid strengths are reduced to 80%.

EXAMPLE 4

Testing in corrosive, abrasive slurries has shown that even at the same level of measured hardness high carbon alloys are far superior in resistance to abrasion or erosion than low carbon alloys, probably due in part to the presence of the extremely hard carbides. For example, the instant alloys in the as cast state range in hardness from 255 to 335 BHN, as contrasted to hardness values from 175 to 260 BHN for the alloys of the '926 patent.

While the ductility of the alloys of the invention may be desirable in many applications, increased hardness after castings production, machining and finishing is often suitable and desirable. The alloys of the invention may be aged to higher hardness levels because of their carbon contents, whereas the '926 alloys cannot.

Samples from alloys of the invention were aged for 240 hours at 1200° F. Their hardness values after aging are set forth in Table V.

TABLE V

AGED HARDNESSES OF ALLOYS OF THE INVENTION

| ALLOY | BHN |
|---|---|
| 1 | 365 |
| 2 | 333 |
| 3 | 275 |
| 4 | 342 |
| 5 | 320 |
| 6 | 303 |
| 7 | 285 |
| 8 | 350 |

From the above, it may be seen that the alloys of the invention combine resistance to the corrosion of hot concentrated sulfuric acid that is equal or superior to the best prior art alloys. Furthermore, the claimed alloys would be expected to exhibit toughness and abrasion or erosion resistance not available in the prior alloys.

Although specific examples of the present invention are provided herein, it is not intended that they are exhaustive or limiting of the invention. These illustrations and explanations are intended to acquaint others skilled in the art with the invention, its principles, and is practical application, so that they may adapt and apply the invention in its numerous forms, as may be best suited to the requirements of a particular use.

What is claimed is:

1. A silicon containing chromium-nickel-iron alloy having improved corrosion resistance consisting of:

| | |
|---|---|
| CHROMIUM | 15-26% BY WEIGHT |
| NICKEL | 15-25% |
| SILICON | 4.5-8% |
| CARBON | 0.5-1.7% |
| COPPER | 1-4% |
| MOLYBDENUM | 0.3-3% |
| MANGANESE | UP TO ABOUT 1.5% |
| IRON | ESSENTIALLY THE BALANCE |

2. An alloy of claim 1 consisting of:

| | |
|---|---|
| CHROMIUM | 17-23% BY WEIGHT |
| NICKEL | 15-23% |
| SILICON | 6.1-7.7% |
| CARBON | 0.5-1.2% |
| COPPER | 2-4% |
| MOLYBDENUM | 0.3-3% |
| MANGANESE | 0.3-1% |
| IRON | ESSENTIALLY THE BALANCE |

3. An alloy of claim 1 wherein the iron content plus impurities is in the range of about 35% to about 57% by weight.

4. An alloy of claim 1 wherein the iron content plus impurities is in the range of about 48% to about 54% by weight.

5. An alloy of claim 2 consisting of:

| | |
|---|---|
| CHROMIUM | 17-19% BY WEIGHT |
| NICKEL | 15-22% |
| SILICON | 6.1-7.7% |
| CARBON | 0.6-1% |
| COPPER | 2-3.2% |
| MOLYBDENUM | 0.5-2% |
| MANGANESE | 0.3-0.6% |
| IRON | ESSENTIALLY THE BALANCE |

6. An alloy of claim 2 consisting of:

| | |
|---|---|
| CHROMIUM | 18-21% BY WEIGHT |
| NICKEL | 17-18.5% |
| SILICON | 6.5-7% |
| CARBON | 0.75-0.9% |
| COPPER | 2-2.5% |
| MOLYBDENUM | 1-1.5% |
| MANGANESE | 0.6-0.95 |

-continued

| | |
|---|---|
| IRON | ESSENTIALLY THE BALANCE |

7. An alloy of claim 5 nominally consisting of:

| | |
|---|---|
| CHROMIUM | 18 BY WEIGHT |
| NICKEL | 17% |
| SILICON | 7% |
| CARBON | 0.8% |
| COPPER | 2.5% |
| MOLYBDENUM | 1% |
| MANGANESE | 0.5% |
| IRON | ESSENTIALLY THE BALANCE |

8. An alloy of claim 5 nominally consisting of:

| | |
|---|---|
| CHROMIUM | 19% BY WEIGHT |
| NICKEL | 15.3% |
| SILICON | 6.1% |
| CARBON | 1% |
| COPPER | 2.1% |
| MOLYBDENUM | 2% |
| MANGANESE | 0.3% |
| IRON | ESSENTIALLY THE BALANCE |

9. An alloy of claim 5 nominally consisting of:

| | |
|---|---|
| CHROMIUM | 17% BY WEIGHT |
| NICKEL | 17% |
| SILICON | 7.7% |
| CARBON | 0.6% |
| COPPER | 3.2% |
| MOLYBDENUM | 0.5% |
| MANGANESE | 0.5% |
| IRON | ESSENTIALLY THE BALANCE |

10. An alloy of claim 2 nominally consisting of:

| | |
|---|---|
| CHROMIUM | 18.6% BY WEIGHT |
| NICKEL | 21.4% |
| SILICON | 7.7% |
| CARBON | 0.9% |
| COPPER | 2.3% |
| MOLYBDENUM | 0.4% |
| MANGANESE | 0.50% |
| IRON | ESSENTIALLY THE BALANCE |

* * * * *